US005543762A

United States Patent [19]

Sigmon

[11] Patent Number: 5,543,762

[45] Date of Patent: Aug. 6, 1996

[54] N-WAY IMPEDANCE TRANSFORMING POWER DIVIDER/COMBINER

[75] Inventor: Bernard E. Sigmon, Gilbert, Ariz.

[73] Assignee: Motorola, Inc., Schaumburg, Ill.

[21] Appl. No.: 373,180

[22] Filed: Jan. 17, 1995

[51] Int. Cl.[6] ..... H01P 5/12

[52] U.S. Cl. ..... 333/128; 333/136

[58] Field of Search ..... 333/109, 116, 333/117, 124, 128, 136

[56] References Cited

U.S. PATENT DOCUMENTS

| | | | |
|---|---|---|---|
| 4,168,479 | 9/1979 | Rubin | 333/128 X |
| 4,281,293 | 7/1981 | Childs et al. | 333/116 X |
| 4,556,856 | 12/1985 | Presser | 333/128 X |
| 4,968,958 | 11/1990 | Hoare | 333/128 |
| 5,376,904 | 12/1994 | Wong | 333/109 |

OTHER PUBLICATIONS

A page from a book entitled "Microwave Filters, Impedance–Matching Networks, and Coupling Structures", ©1964, p. 227., Matthaei et al., McGraw–Hill Co., N.Y.

*Primary Examiner*—Paul Gensler

*Attorney, Agent, or Firm*—Bradley J. Botsch, Sr.; Jeffrey D. Nehr

[57] ABSTRACT

An impedance transforming power divider/combiner includes a first transmission line (60) with a first terminal (65) and N transmission line fingers (65, 66, 68, 70) terminating in N transmission line finger ends. N transmission lines (28, 38, 48, 58) having N first and second ends are positioned in close proximity to the N transmission line fingers (65, 66, 68, 70) in one-to-one correspondences. The N second ends of the N transmission lines (28, 38, 48, 58) are coupled through N individual impedances (20, 30, 40, 50) to N terminals (25, 35, 45, 55). If signal power is provided to the first terminal (64), the signal power is divided into N signal power outputs at the N terminals (25, 35, 45, 55). If signal power is provided to the N terminals (25, 35, 45, 55), a combined signal power results at the first terminal (65).

15 Claims, 2 Drawing Sheets

N-WAY IMPEDANCE TRANSFORMING POWER DIVIDER/COMBINER

FIELD OF THE INVENTION

This invention relates in general to power dividers and combiners and in particular to impedance transforming power divider/combiners.

BACKGROUND OF THE INVENTION

Power dividers and combiners are useful in a wide variety of circuits. Specific applications include combining multiple power amplifier stages in order to achieve a desired high power output. Since most solid state power devices, such as MESFETs, PHEMTs, and bipolar transistors have low input and output impedances, successive impedance transformations are often necessary to achieve 50 ohm input and output impedance levels.

There are several technologies which currently provide power dividing/combining, including radial combiners, split lines, and branch line combiners. While these power combining/dividing methods and apparatus may be suitable for many applications, they do not provide for power combining/dividing over a broadband of frequencies with good isolation between the combined signals while simultaneously achieving a wide range of impedance transformations in a compact size. For example, radial combiners, typically machined out of metal, tend to be large structures and not well suited to size-critical applications. Simple split lines divide or combine power simply, but offer no isolation between ports. Branch line couplers are reactive, and have no resistors to dissipate out-of-phase energy.

A power combiner/divider known as the Wilkinson power divider offers binary dividing/combining (i.e., successive divisions or multiplications by two). The Wilkinson power divider/combiner is limited in that the divisions/multiplications are always by a factor of 2 and the input and output impedances are all equal to a characteristic impedance $Z_o$. The Wilkinson design does not facilitate the use of different input and output impedances regardless of whether it is used as a combiner or a divider. Since the Wilkinson power divider/combiner uses quarter-wavelength lines in each division/multiplication and is binary, each division/multiplication past the first requires space for the additional quarter-wavelength lines. Moreover, the Wilkinson power divider/combiner does not offer N-way combining, low insertion loss, or broad bandwidth response.

There is a need for power combining/dividing and impedance transformation functions over a broad band of frequencies with good isolation between the combined signals, while simultaneously achieving a wide range of possible impedance transformations using a method and apparatus suitable for use in microstrip technologies, including microwave monolithic integrated circuits (MMICs). To be cost effective, these functions must be accomplished without requiring a great deal of surface area on a semiconductor die.

DETAILED DESCRIPTION OF THE DRAWINGS

While the impedance transforming N-way power divider/combiner discussed is particularly suited for the application described below, other applications for the impedance transforming power divider/combiner using lumped elements will be readily apparent to those of skill in the art.

Figure 1:
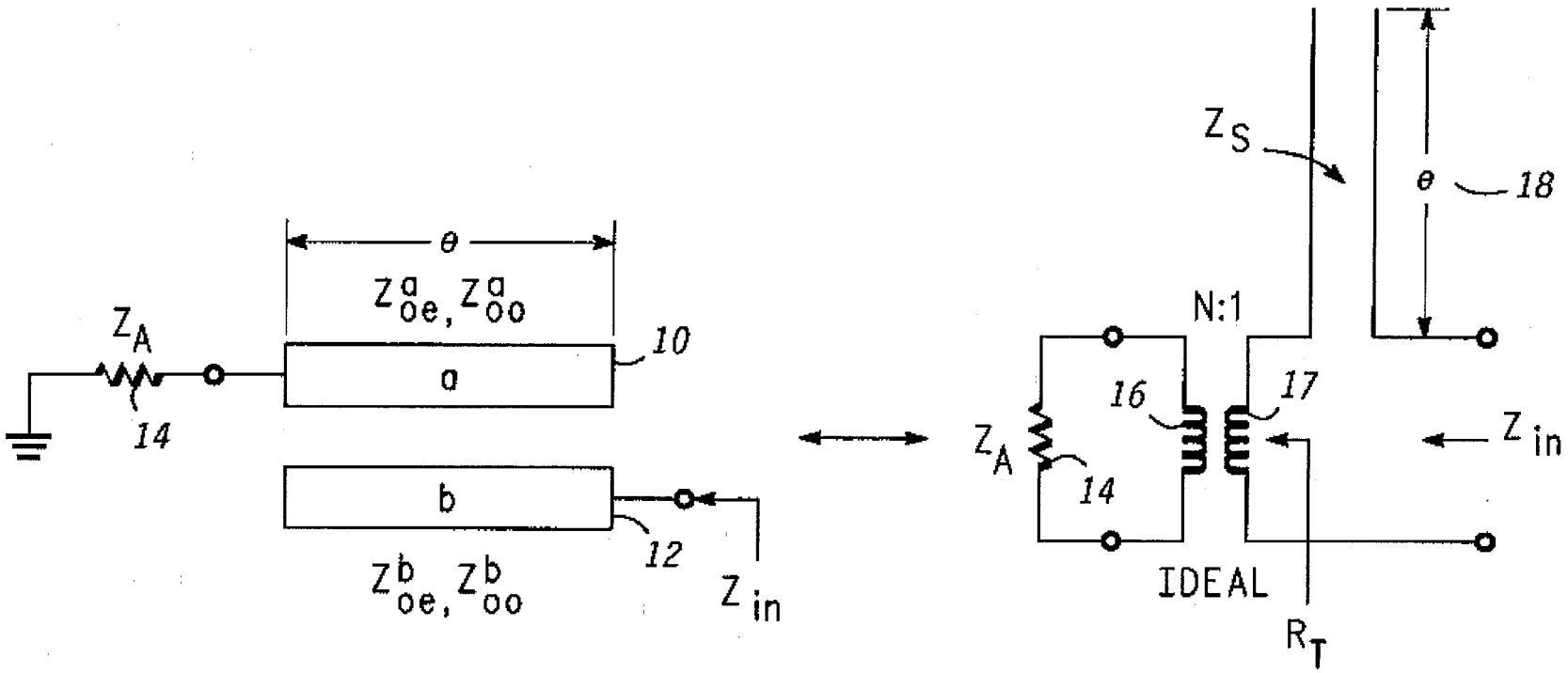
FIG. 1 (PRIOR ART)
In FIG. 1, there is shown a prior art equivalent circuit representation depicting correspondence between parallel coupled transmission lines and a coupled pair of inductors.

The present invention can be more fully understood with reference to the figures. FIG. 1 illustrates a prior art representation of an equivalent circuit depiction between parallel coupled transmission lines and a coupled pair of inductors. A discussion of the electrical properties of parallel coupled lines as they relate to impedance transformation is set forth in Mathaei et al., "Microwave Filters, Impedance-Matching Networks, and Coupling Structures" (see page 227 for a mathematical equivalency), which is herein incorporated by reference.

The FIG. 1 illustration depicts a prior art correspondence between closely-spaced parallel transmission lines 10 and 12 (labeled "a" and "b", respectively, for superscripts below) and coupled inductors with a N:1 turn ratio. The left portion of FIG. 1 depicts transmission lines 10 and 12 of phase length Θ. The odd and even mode characteristic impedances for transmission line 10 are represented by $Z^a_{oo}$ and $Z^a_{oe}$, respectively. The odd and even mode characteristic impedances for transmission line 12 are represented by $Z^b_{oo}$ and $Z^a_{oe}$, respectively. $Z_{in}$ is the input impedance looking into a first end of transmission line 12 (calling the opposite end of transmission line 12 a second end). $Z_A$ is an impedance coupled between electrical ground and a second end of transmission line 10 (i.e. an end of transmission line 10 which lines up adjacent to the second end of transmission line 12). A special constraint of the correspondence analysis is that $Z^a_{oe}+Z^a_{oo}=2Z_A$.

The right portion of FIG. 1 depicts a primary section of an open wire length Θ with characteristic impedance $Z_s$ coupled between a first input terminal and an inductor of resistance $R_T$. The input characteristic impedance $Z_{in}$ is the impedance looking into the right-most section of FIG. 1. The left-most section of the equivalence comprises impedance $Z_A$ coupled to an inductor 16. The inductors 16 and 17 are chosen to provide a N:1 ideal transformation. Mathaei et al. show the following equivalencies between the parallel coupled transmission line representation and the coupled inductor representation:

$$Z^a_{oe}=Z_A\left[\sqrt{\frac{R_T}{Z_A}}+1\right] \quad \text{Equation 1}$$

$$Z^a_{oo}=2Z_A-Z^a_{oe} \quad \text{Equation 2}$$

$$Z^b_{oo}=Z_s-Z_A\left[1-\frac{R_T}{Z_A}\right]+Z^a_{oo} \quad \text{Equation 3}$$

$$Z^b_{oe}=Z^b_{oo}+Z^a_{oe}-Z^a_{oo} \quad \text{Equation 4}$$

$$Z_s=Z_A\left[\frac{N^2-1}{N^2}\right]+Z^b_{oo}-Z^a_{oo} \quad \text{Equation 5}$$

$$N=\frac{2Z_A}{Z^a_{oe}-Z^a_{oo}} \quad \text{Equation 6}$$

-continued $$R_T = \frac{Z_A}{N^2} \quad \text{Equation 7}$$

Figure 2:
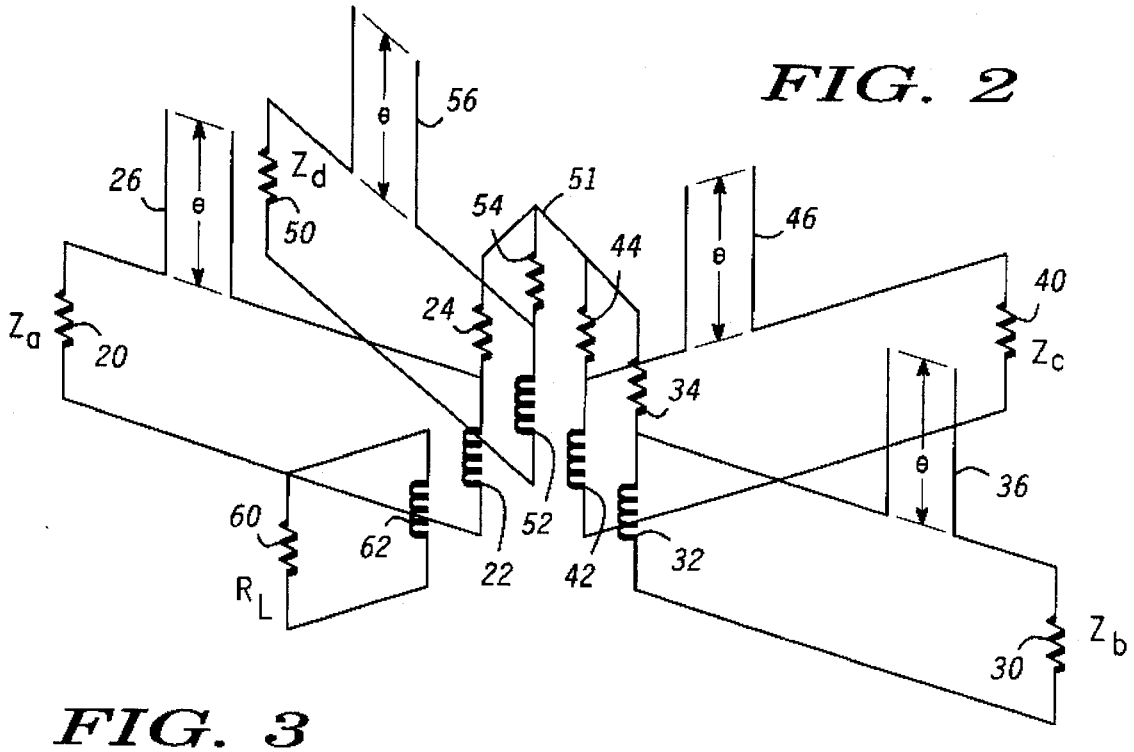
In FIG. 2, there is shown a schematic of an equivalent circuit providing for N-way power dividing/combining according to a preferred embodiment in accordance with the present invention; and In FIG. 3, there is shown a topological representation of a four-way power combiner/divider depicting a preferred embodiment in accordance with the present invention.

In FIG. 2, there is shown a schematic of an equivalent circuit providing for N-way power dividing/combining according to a preferred embodiment in accordance with the present invention. The equivalency of parallel coupled lines to coupled inductors is generalized to the situation with a four-way combination or division. In the case of a combination, each source of four sources a, b, c, and d is represented in turn by characteristic impedances 20 ($Z_a$), 30 ($Z_b$), 40 ($Z_c$), and 50 ($Z_d$), respectively. Each source comprises an open wire line of length Θ (reference numbers 26, 36, 46, and 56, respectively, for each of the sources a, b, c, and d). Inductors 22, 32, 42, and 52 represent the closely coupled inductors which combine power from sources a, b, c, and d. Inductor 62, at which the combined power appears, is also closely coupled to inductors 22, 32, 42, and 52 and is in series with resistor 60 ($R_L$), the load resistor for the power combination output. One side of each of the inductors 22, 32, 42, and 52 is coupled through a series resistor (resistor 24 for source a, resistor 34 for source b, resistor 44 for source c, and resistor 54 for source d) to a common node 51.

The FIG. 2 embodiment functions as a power combiner by accepting input power from sources a, b, c, and d, combining power from all the sources, and outputting the combined power to resistor 60. The FIG. 2 schematic can be envisioned as a power divider by functioning in an inverse fashion. E.g, if power is input to what was the load in the case of power combining, i.e. to resistor 60, the input power is divided and output at through impedances 20, 30, 40, and 50. The number of combinations or divisions can be generalized to more or less than four, as is shown.

Figure 3:
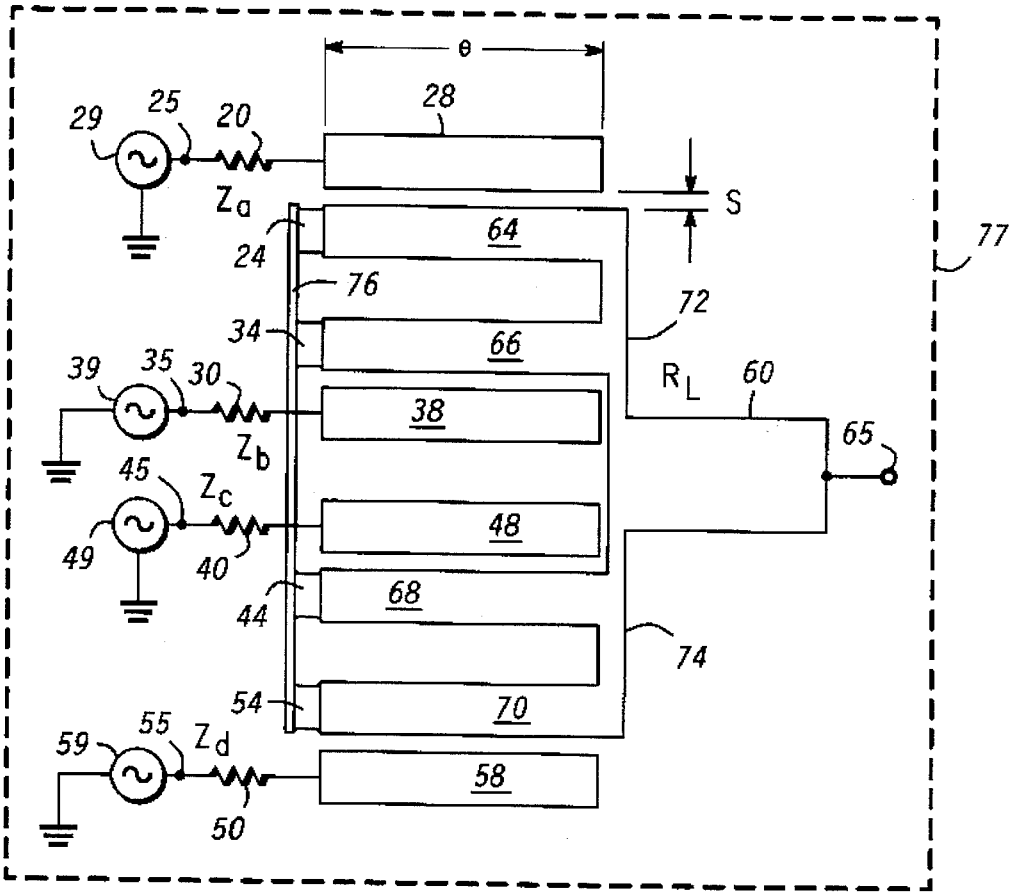

In FIG. 3, there is shown a topological representation of a four-way power combiner/divider depicting a preferred embodiment in accordance with the present invention. The specific number of combinations or divisions represented is again four, but, in general, the number can be generalized to any number greater than or equal to two. The FIG. 3 divider/combiner is shown within portable communication device 77 and applies coupled inductor equivalence to parallel transmission lines. Sources 29, 39, 49, and 59 are analogous to power sources a, b, c, and d in the power combining representation described in FIG. 2. Source 29 is coupled between electrical ground and node 25 and characteristic impedance $Z_a$ is coupled between node 25 and a first end of transmission line 28. Similarly, source 39 is coupled between electrical ground and node 35 and characteristic impedance $Z_b$ is coupled between node 35 and a first end of transmission line 38. Source 49 is coupled between electrical ground and node 45 and characteristic impedance $Z_c$ is coupled between node 45 and a first end of transmission line 48. Finally, source 59 is coupled between electrical ground and node 55 and characteristic impedance $Z_d$ is coupled between node 55 and a first end of transmission line 58. In a preferred embodiment of the invention depicted schematically in FIG. 3, transmission lines 28, 38, 48, and 58 are oriented in parallel and with the first ends of each approximately in alignment.

Positioned parallel to each of transmission lines 28, 38, 48, and 58 are transmission line fingers 64, 66, 68, and 70, which are "fingers" extending from transmission line 60. A first end of each of transmission lines 64 and 66 are coupled to transmission line 60 through coupling transmission line 72. A first end of each of transmission lines 68 and 70 are coupled to transmission line 60 through coupling transmission line 74. Second ends of transmission lines 64, 66, 68, and 70 are coupled, respectively, through balance resistors 24, 34, 44, and 54 to common conductor 76.

In the preferred embodiment represented in FIG. 3, transmission lines 64, 66, 68, and 70 are spaced a distance "s" away from transmission lines 28, 38, 48, and 58, respectively, and both ends of transmission lines 64, 66, 68, and 70 approximately align with the ends of transmission lines 28, 38, 48, and 58. Transmission line 60 is one quarter wavelength in length with respect to the signal of interest. For example, the FIG. 3 embodiment can be used to divide or combine signals in portable communication devices such as satellite cellular communications signal processors, processing 1.6 GHz signals at power levels of 20 watts (W) or more. The power divider/combiner is capable of handling a wide spectrum of frequencies and power levels.

Port 65 in FIG. 3 functions as an output port for the combination of the four sources 29, 39, 49, and 59. If the embodiment represented in FIG. 3 is used as a power divider, sources 29, 39, 49, and 59 (and their respective couplings to electrical ground) are removed and a source to be divided is coupled to port 65, which becomes an input port. Nodes 25, 35, 45, and 55 become output ports in the power divider mode.

Any microstrip (planar) media, such as microwave monolithic integrated circuitry (MMIC) can be used to implement the FIG. 3 embodiment. In such an embodiment the parallel transmission lines spacing "s" can range from approximately 0.254 mm( 10 mils) to approximately 1–2 microns. As contrasted with a Wilkinson power combiner/divider, no DC blocking capacitor is required for implementation.

A key feature of the present N-way divider/combiner is the compactness of the design which conserves space when the divider/combiner is implemented. Compact implementations are important for saving space on semiconductor die surfaces, particularly for gallium arsenide (GaAs) implementations. Note that the length of the FIG. 3 N-way power combiner/divider does not change as N increases, since additional interdigitated transmission lines can be placed adjacent to the previous interdigitated transmission lines. The Wilkinson power, combiner/divider conversely, requires additional quarter wavelength lengths for implementation for each power division/combination by two and for impedance transformation to achieve 50 ohm impedance. Thus, a four-way Wilkinson power divider/combiner is longer than a two-way Wilkinson power divider/combiner, and longer than a four-way implementation of a power/divider combiner in accordance with the present invention.

Reduction of path length in the N-way power divider/combiner also gives rise to decreased transmission loss. The coupled transmission lines in the FIG. 3 power divider/combiner embodiment eliminate the need for extra components, further conserving space in implementation. The N-way power divider/combiner is useful for both high power and high frequency applications.

Thus, a N-way impedance transforming power divider/combiner has been described which overcomes specific problems and accomplishes certain advantages relative to prior art methods and mechanisms. The improvements over known technology are significant. The method and apparatus described provide a means by which N signals can be power combined over a broad band of frequencies with good isolation between the combined signals and simultaneously achieve a wide range of impedance transformations (including 50:1). The broad band responses can be up to 40 percent bandwidth flat responses and the isolation between the signals paths can exceed 20 dB. Less path loss occurs than with other planar power dividers/combiners due to shorter path length, and DC isolation occurs without using additional capacitive elements, since the input and output lines are not DC connected.

There has been provided a N-way impedance transforming power divider/combiner that fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

What is claimed is:

1. A N-way impedance transforming power divider for dividing signal power into N signal power outputs (where N is an integer number greater than or equal to two) comprising:

a first transmission line having a first end and a second end, wherein the first end comprises a first terminal and the second end comprises N transmission line fingers terminating in N transmission line finger ends;

N transmission lines having N first ends and N second ends, wherein the N transmission lines are positioned in close proximity to the N transmission line fingers in one-to-one correspondences; and N impedances, wherein the N second ends of the N transmission lines are coupled through the N impedances to N terminals, and the signal power provided to the first terminal is divided into the N signal power outputs at the N terminals.

2. A N-way impedance transforming power divider as claimed in claim 1, wherein the N transmission line fingers and the N transmission lines are all substantially parallel in each of the one-to-one correspondences.

3. A N-way impedance transforming power divider as claimed in claim 1, wherein the N transmission line fingers and the N transmission lines are all substantially parallel.

4. A N-way impedance transforming power divider as claimed in claim 2, wherein the N transmission line fingers and the N transmission lines are all substantially planar.

5. A N-way impedance transforming power divider as claimed in claim 2, wherein the N transmission line finger ends are substantially aligned with the N second ends of the N transmission lines.

6. A N-way impedance transforming power divider as claimed in claim 1, wherein the N transmission line fingers and the N transmission lines are all one-quarter wavelength in length at an operating frequency of the signal power.

7. A N-way impedance transforming power combiner for combining signal power into a combined signal power output (where N is a integer number greater than or equal to two) comprising:

a first transmission line having a first end and a second end, wherein the first end comprises a first terminal and the second end comprises N transmission line fingers terminating in N transmission line finger ends;

N transmission lines having N first ends and N second ends, wherein the N transmission lines are positioned in close proximity to the N transmission line fingers in one-to-one correspondences wherein the N transmission line fingers and the N transmission lines are all substantially parallel in each of the one-to-one correspondences and wherein the N transmission line fingers and the N transmission lines are all substantially parallel; and N impedances, wherein the N second ends of the N transmission lines are coupled through the N impedances to N terminals, and the signal power provided to the N terminals results in the combined signal power output at the first terminal.

8. A N-way impedance transforming power combiner as claimed in claim 7, wherein the N transmission line fingers and the N transmission lines are all substantially planar.

9. A N-way impedance transforming power combiner as claimed in claim 7, wherein the N transmission line finger ends are substantially aligned with the N second ends of the N transmission lines.

10. A N-way impedance transforming power combiner as claimed in claim 7, wherein the N transmission line fingers and the N transmission lines are all one-quarter wavelength in length at an operating frequency of the signal power.

11. A portable communication device having a N-way impedance transforming power divider/combiner for dividing signal power into N signal power outputs or combining the signal power provided to N terminals into a combined signal power (where N is an integer number greater than or equal to two) comprising:

a first transmission line having a first end and a second end, wherein the first end comprises a first terminal and the second end comprises N transmission line fingers terminating in N transmission line finger ends;

N transmission lines having N first ends and N second ends, wherein the N transmission lines are positioned in close proximity to the N transmission line fingers in one-to-one correspondences wherein the N transmission line fingers and the N transmission lines are all substantially parallel and planar and wherein the N transmission line finger ends are substantially aligned with the N second ends of the N transmission lines; and N impedances, wherein the N second ends of the N transmission lines are coupled through the N impedances to N terminals, and signal power provided to the first terminal is divided into N signal power outputs at the N terminals, and the signal power provided to the N terminals, results in a combined signal power at the first terminal.

12. A portable communication device as claimed in claim 11, wherein the N transmission line fingers and the N transmission lines are all one-quarter wavelength in length at an operating frequency of the signal power.

13. A N-way impedance transforming power divider for dividing signal power into N signal power outputs (where N is an integer number greater than or equal to two) comprising:

a first transmission line having a first end and a second end, wherein the first end comprises a first terminal and the second end comprises N transmission line fingers terminating in N transmission line finger ends;

N transmission lines having N first ends and N second ends, wherein the N transmission lines are positioned in close proximity to the N transmission line fingers in one-to-one correspondences and wherein the N transmission line fingers and the N transmission lines are all substantially parallel in each of the one-to-one correspondences and wherein the N transmission line finger ends are substantially aligned with the N second ends of the N transmission lines; and N impedances, wherein the N second ends of the N transmission lines are coupled through the N impedances to N terminals, and the signal power provided to the first terminal is divided into the N signal power outputs at the N terminals.

14. A N-way impedance transforming power divider as claimed in claim 13, wherein the N transmission line fingers and the N transmission lines are all substantially parallel.

15. A N-way impedance transforming power divider as claimed in claim 13, wherein the N transmission line fingers and the N transmission lines are all one-quarter wavelength in length at an operating frequency of the signal power.

* * * * *